US010076004B2

(12) United States Patent
Kanzaki et al.

(10) Patent No.: US 10,076,004 B2
(45) Date of Patent: Sep. 11, 2018

(54) MICROWAVE OVEN

(75) Inventors: Kouji Kanzaki, Nara (JP); Kazuhiro Kawai, Osaka (JP); Hisahiro Nishitani, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1938 days.

(21) Appl. No.: 13/147,539

(22) PCT Filed: Feb. 17, 2010

(86) PCT No.: PCT/JP2010/000963

§ 371 (c)(1),
(2), (4) Date: Aug. 2, 2011

(87) PCT Pub. No.: WO2010/098038

PCT Pub. Date: Sep. 2, 2010

(65) Prior Publication Data

US 2011/0284528 A1 Nov. 24, 2011

(30) Foreign Application Priority Data

Feb. 24, 2009 (JP) ..... 2009-040798

(51) Int. Cl.
*H05B 6/64* (2006.01)
*H05B 6/66* (2006.01)

(52) U.S. Cl.
CPC ..... *H05B 6/666* (2013.01); *H05B 6/642* (2013.01)

(58) Field of Classification Search
CPC ..... H05B 2206/046; H05B 6/64; H05B 6/80; H05B 6/806

(Continued)

(56) References Cited

U.S. PATENT DOCUMENTS 4,376,131 A * 3/1983 Mori et al. ..... 426/231
5,022,756 A 6/1991 Rhodes (Continued)

FOREIGN PATENT DOCUMENTS

CN 1642366 A 7/2005
CN 1875661 A 12/2006

(Continued)

OTHER PUBLICATIONS

Machine translation of JP2002-260841.*

(Continued)

*Primary Examiner* — Tu B Hoang
*Assistant Examiner* — Thomas Ward
(74) *Attorney, Agent, or Firm* — Brinks Gilson & Lione

(57) ABSTRACT

A microwave oven includes: heating chamber (11) for accommodating a heating object; magnetron (12) for heating the heating object accommodated in heating chamber (11); blower (13) for cooling magnetron (12); temperature detection device (17) for detecting a temperature of magnetron (12); and a control device for controlling an output power of magnetron (12) on the basis of temperature information output from temperature detection device (17), wherein temperature detection device (17) is disposed inside cooling fin (19) of magnetron (12), and the control device controls magnetron (12) on the basis of the temperature information obtained before cooking is started, thereby reducing a temperature transfer loss of abnormal heat generated from magnetron (12) and efficiently transferring the heat.

14 Claims, 6 Drawing Sheets

(58) Field of Classification Search
USPC ..... 219/678–763
See application file for complete search history.

(56) References Cited

U.S. PATENT DOCUMENTS

| | | | | |
|---|---|---|---|---|
| 5,877,395 | A * | 3/1999 | Emery | 422/186 |
| 5,897,807 | A * | 4/1999 | Edgar et al. | 219/700 |

FOREIGN PATENT DOCUMENTS

| | | | |
|---|---|---|---|
| CN | 101539309 | A | 9/2009 |
| EP | 0 477 633 | A1 | 4/1992 |
| GB | 2 321 764 | A | 8/1998 |
| JP | 05-280744 | A | 10/1993 |
| JP | 06-185738 | A | 7/1994 |
| JP | 10-270162 | A | 10/1998 |
| JP | 2002-260841 | A | 9/2002 |
| JP | 2005-174678 | A | 6/2005 |
| JP | 2005-203211 | A | 7/2005 |
| JP | 2005-241128 | A | 9/2005 |
| JP | 2009-228968 | A | 10/2009 |

OTHER PUBLICATIONS

International Search Report for International Application No. PCT/J132010/000963, dated May 25, 2010, 3 pp.
Supplementary European Search Report in corresponding European Application No. 10 74 5925, dated Jan. 2, 2014, 6 pages.

* cited by examiner

MICROWAVE OVEN

TECHNICAL FIELD

The present invention relates to a microwave oven that heats a heating object through high frequency supplied from a magnetron or the like.

BACKGROUND ART

Hitherto, there has been known a microwave oven which includes a temperature detection device inside an air guide as a passage through which an exhaust air stream flows in order to detect the temperature of the exhaust air stream of the magnetron, where the temperature detection device is provided for the purpose of preventing damage to the apparatus caused by abnormal heat generated from the magnetron when the apparatus is operated while there is no heating object inside a heating chamber (for example, refer to PTL 1). FIG. 6 is a plan cross-sectional view illustrating a configuration of a conventional microwave oven. FIG. 6 illustrates a configuration in which a temperature detection device is attached to an air guide of the conventional microwave oven. As shown in FIG. 6, the microwave oven includes: heating chamber 1 accommodating a heating object; magnetron 2 supplying high frequency to heating chamber 1; cooling device 3 supplying a cooling air to heating chamber 1 and magnetron 2; air guide 4 guiding a cooling air used to cool magnetron 2 toward heating chamber 1; and temperature detection device 5 provided inside air guide 4 and detecting the temperature of a cooling air. Although not shown in the drawings, magnetron 2 includes an anode to which power is supplied and a cooling fin which is disposed inside an air stream path of the cooling air.

However, in the conventional configuration, the temperature of abnormal heat generated from magnetron 2 is transferred from the anode to the cooling fin, the cooling air flowing around the cooling fin is heated, and the temperature of the heated exhaust air stream is detected by temperature detection device 5. For this reason, there are problems that it takes time to thermally transfer the temperature of the abnormal heat to temperature detection device 5 and an abrupt increasing temperature may not be detected.

Further, since an allowance of a detection control level is ensured (an allowable range is set to be wide) in order to prevent erroneous detection due to the above-described reasons, a problem arises in reliability of a temperature control.

[PTL 1] Japanese Patent Unexamined Publication No. H06-185738

DISCLOSURE OF THE INVENTION

The present invention is made to solve the above-described problems, and provides a microwave oven that improves the precision of the detection precision when a user operates the microwave oven in a no-load state by mistake, prevents damage of the apparatus, and has high safety and reliability.

A microwave oven of the present invention includes: a heating chamber for accommodating a heating object; a magnetron for heating the heating object accommodated in the heating chamber; a blower for cooling the magnetron; a temperature detection device for detecting a temperature of the magnetron; and a control device for controlling an output power of the magnetron on the basis of temperature information output from the temperature detection device, wherein the temperature detection device is disposed inside a cooling fin of the magnetron and the control device controls the magnetron on the basis of the temperature information obtained before cooking is started.

Accordingly, the temperature of the abnormal heat generated from the magnetron may be directly transferred from the anode to the temperature detection device via the cooling fin, and the heat may be highly efficiently transferred by reducing a temperature transfer loss. Also, since the abnormality detection control is performed on the basis of the temperature information obtained before the cooking is started, the erroneous detection due to repeated heating may be prevented.

Further, a microwave oven may be provided which improves the precision of the detection of abnormality in a no-load operation state, prevents the damage of the apparatus, and has high safety and reliability.

DETAILED DESCRIPTION OF THE PREFERRED EMBODIMENTS

Figure 1:
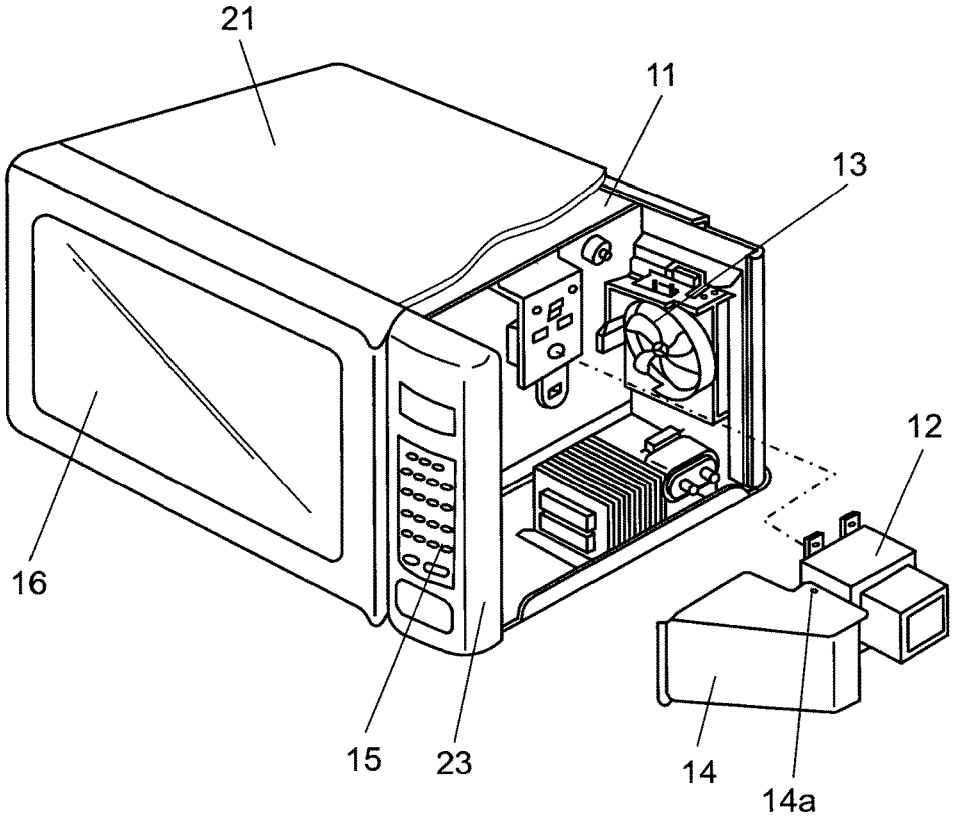
FIG. 1 is a diagram illustrating an external shape of a microwave oven of an embodiment of the present invention.

Hereinafter, an embodiment of the present invention will be described by referring to the drawings. Further, the present invention is not limited to the embodiment.

Figure 2:
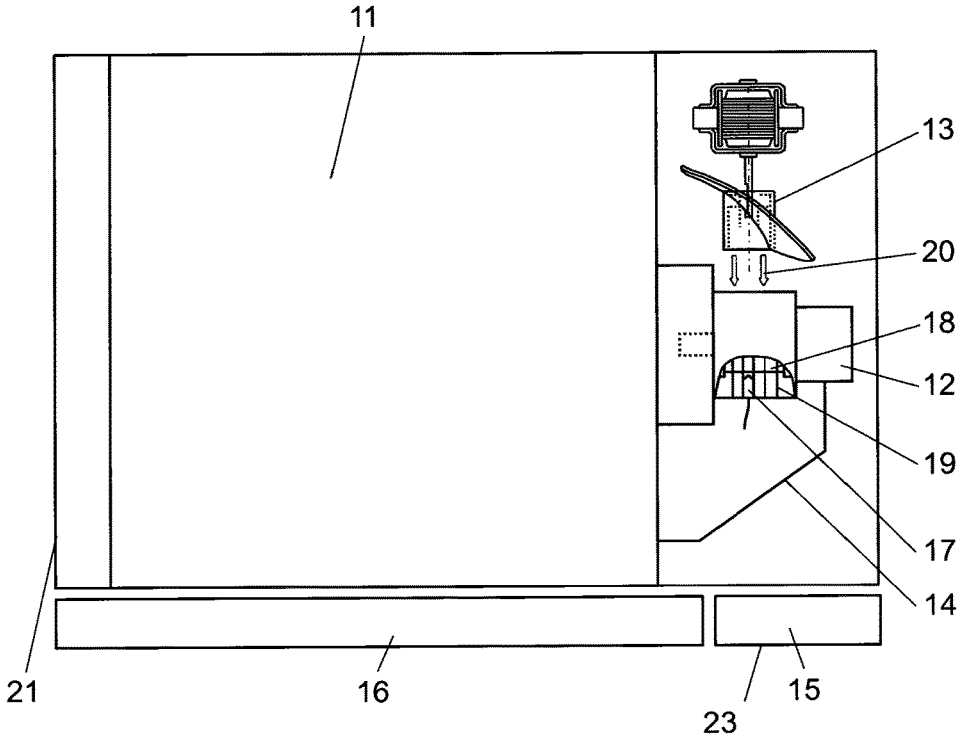
FIG. 2 is a cross-sectional view illustrating the microwave oven of the embodiment of the present invention when seen from the top surface thereof.

FIG. 1 is a diagram illustrating an external shape of a microwave oven of the embodiment of the present invention, and FIG. 2 is a cross-sectional view illustrating the microwave oven when seen from the top surface thereof.

As shown in FIG. 1, the microwave oven of the embodiment includes: heating chamber 11 accommodating a heating object; magnetron 12 generating high frequency; blower 13 cooling magnetron 12; air guide 14 guiding a cooling air used to cool magnetron 12 toward heating chamber 11; operation unit 15 equipped with control device 23; door 16 opening and closing an opening of heating chamber 11; and exterior frame 21.

Further, as shown in FIG. 2, temperature detection device 17 detecting the temperature of magnetron 12 is inserted and fixed to contact cooling fin 19 at a position adjacent to anode 18 of magnetron 12 between the outflow side of cooling air 20 from blower 13 and cooling fin 19. Further, temperature detection device 17 is disposed at the lower air stream side of anode 18 where cooling air 20 generated from blower 13 is not directly blown, and may detect the temperature of magnetron 12 without the influence of cooling air 20.

Figure 3A:
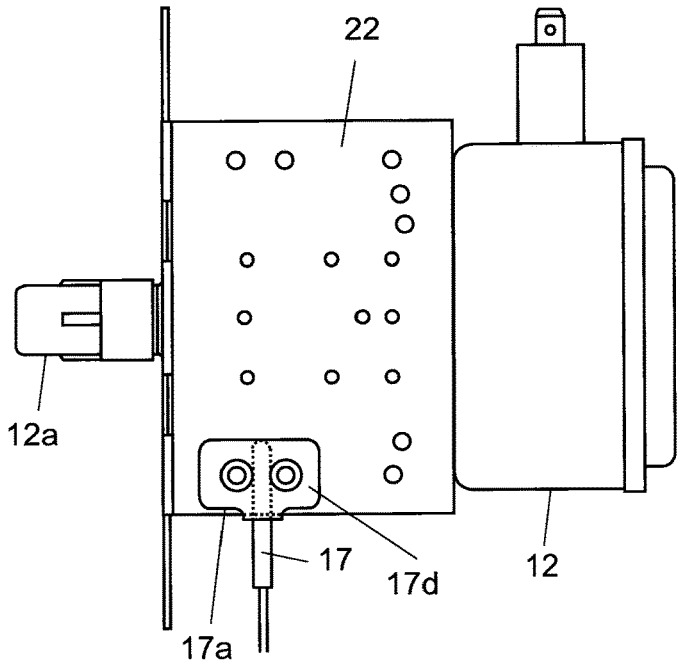
FIG. 3A is a plan view illustrating a main part of the microwave oven of the embodiment of the present invention.
Figure 3B:
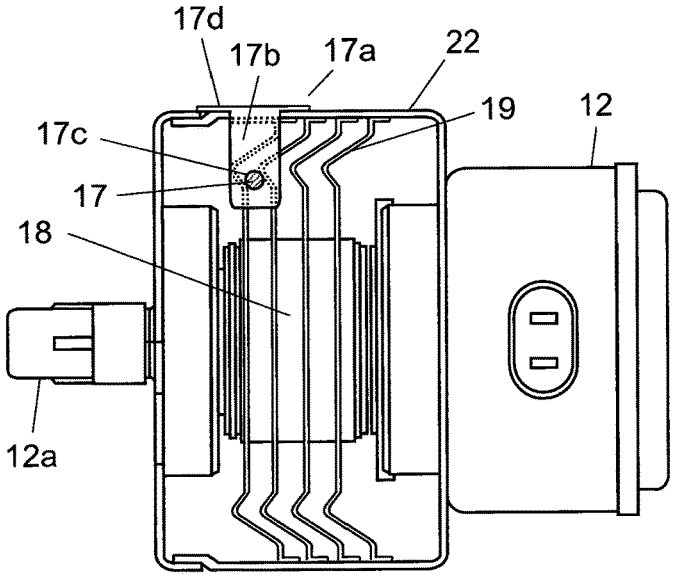
FIG. 3B is a front view illustrating a main part of the microwave oven of the embodiment of the present invention.

FIGS. 3A and 3B are plan and front views respectively illustrating an attachment portion of temperature detection device 17 of the microwave oven of the embodiment. That is, FIG. 3B is a view when seen from the front surface side (the side of operation unit 15) of heating chamber 11. In the embodiment, as shown in FIGS. 3A and 3B, magnetron 12 includes antenna 12*a* that emits radio waves toward heating chamber 11 via anode 18. Plural thin-sheet-shaped cooling fins 19 are disposed around anode 18 at a predetermined interval. Each cooling fin 19 is fixed to the inner peripheral wall of frame 22 surrounding anode 18. In order to prevent deformation of cooling fin 19 which is a thin sheet, the end portion of each cooling fin 19 fixed to the inner peripheral wall of frame 22 has a bent portion that improves bending strength. Accordingly, cooling fins 19 are not easily deformed, and may keep a predetermined interval for cooling. Temperature detection device 17 is caulk-fixed to attachment hole 17*c* that is formed at one-side piece portion 17*b* of attachment plate 17*a* obtained by bending a T-shaped sheet piece in an L-shape. The other-side piece portion 17*d* of attachment plate 17*a* is screw-fixed to the top surface of frame 22. At this time, attachment plate 17*a* and air guide 14 are simultaneously fixed to frame 22 by a screw or the like via screw hole 14*a* formed in air guide 14 shown in FIG. 1. It is desirable that temperature detection device 17 contacts cooling fin 19. Further, in the embodiment, used is temperature detection device 17 has a configuration in which a temperature detection element such as a thermistor is enclosed in a metallic casing, but the present invention is not particularly limited to the configuration.

As described above, in the embodiment, temperature detection device 17 is installed by using a gap at the end portion around the reinforcement portion of cooling fin 19. Accordingly, when temperature detection device 17 is inserted between thin-sheet-shaped cooling fins 19, cooling fin 19 is not deformed. Further, since the temperature detection device is installed inside cooling fin 19 and is fixed to attachment plate 17*a* attached to frame 22, the temperature of magnetron 12 may be detected with high precision. The detection precision may be further improved when temperature detection device 17 is installed to contact cooling fin 19.

Figure 4:
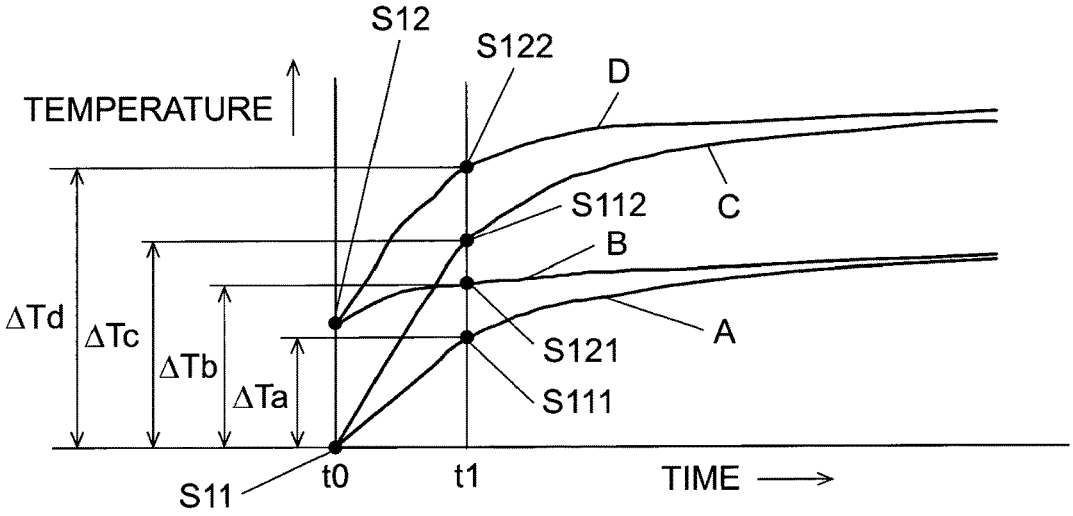
FIG. 4 is a temperature characteristic diagram illustrating a relationship between a temperature detected by a temperature detection device and time of the embodiment of the present invention.

FIG. 4 is a diagram illustrating an example of a relationship between a temperature detected by temperature detection device 17 of the microwave oven of the embodiment having the above-described configuration and time.

In general, when a heating object such as food is present in heating chamber 11 of the microwave oven, an increase in temperature of temperature detection device 17 is depicted by the curve A in the graph of FIG. 4. However, when there is no food or the like in heating chamber 11, an increase in temperature of the temperature detection device is depicted by the curve C greater than the curve A.

This is due to the following reasons. Radio waves supplied from magnetron 12 are guided toward heating chamber 11 in a condition without a load such as food. However, since there is no food absorbing radio waves, the radio waves are reflected from heating chamber 11 and are returned to magnetron 12, so that the temperature of anode 18 increases. A difference in temperature between the curves A and C may be different in accordance with the type or the amount of food, but generally the temperature of the curve C increases when there is no load.

When a difference in temperature of temperature detection device 17 fixed to magnetron 12 is compared, it is possible to determine whether there is no load since there is an obvious difference between an increasing temperature value (ΔTa) when there is a heating object such as food in heating chamber 11 and an increasing temperature value (ΔTc) when there is no load such as food in heating chamber 11.

However, when the microwave oven is repeatedly operated, the temperature of magnetron 12 is high. Also, when there is a heating object such as food in heating chamber 11, the temperature increases like the curve B of the graph in FIG. 4. The increasing temperature value (ΔTb) in that case becomes higher than the increasing temperature value (ΔTa) in the case of cooling and a difference with respect to a temperature value (ΔTc) becomes smaller. Accordingly, the possibility of erroneous detection increases.

For this reason, a threshold value is set on the basis of temperature information of temperature detection device 17 before cooking is started, and it is determined that the repeated operations are performed when the current temperature is the threshold temperature or more. In this case, since an increasing temperature value becomes ΔTd when there is no load after the repeated operations, there is an obvious difference compared to the increasing temperature value (ΔTb) when there is a heating object such as food. Accordingly, it is possible to determine whether there is no load.

Figure 5:
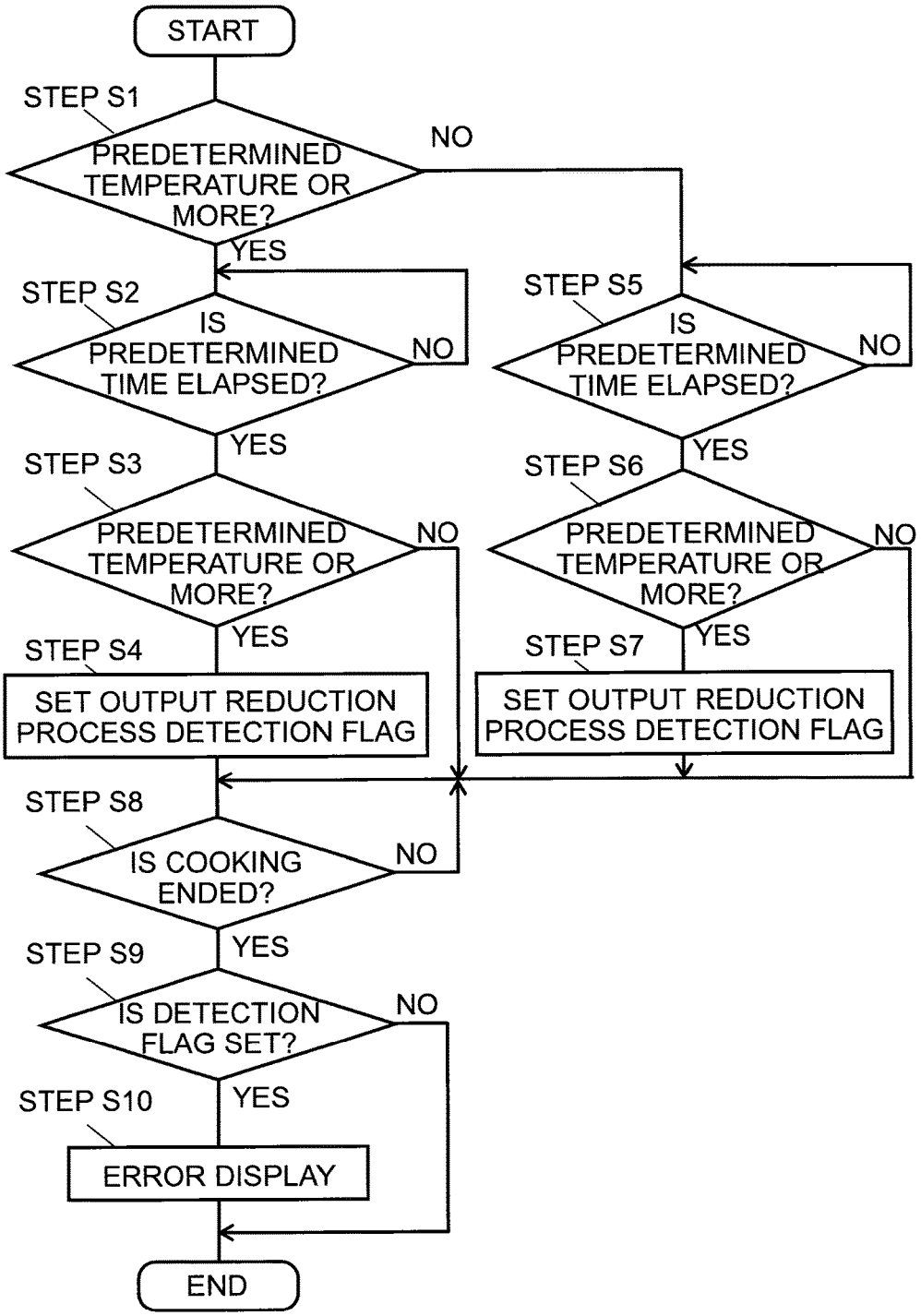
FIG. 5 is a flowchart illustrating a control example of the microwave oven of the embodiment of the present invention.
Figure 6:
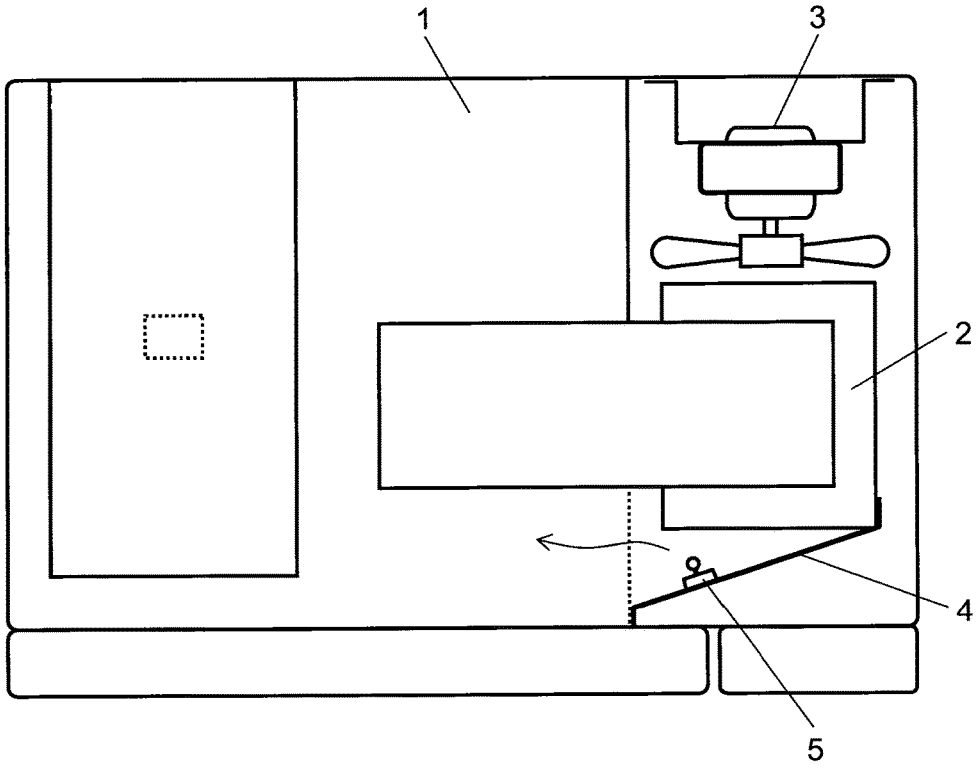
FIG. 6 Prior Art
FIG. 6 is a cross-sectional view illustrating a conventional microwave oven when seen from the top surface thereof.

Next, a control of the embodiment will be described. FIG. 5 is a flowchart illustrating a control of the microwave oven of the embodiment.

In step S1, control device 23 confirms whether the current temperature is a predetermined temperature or more on the basis of the temperature information of temperature detection device 17 immediately after the start of the control, and determines whether the repeated operations are performed (it is determined whether it is a repeated operation state S12 or a normal state S11 at the timing t0 of FIG. 4). When the current temperature is a predetermined temperature or more (S12 of FIG. 4), it is determined that the repeated operations are performed (YES of step S1), and the current process proceeds to step S2. When the current temperature is not a predetermined temperature or more, it is determined that the repeated operations are not performed (NO of step S1), and the current process proceeds to step S5.

When the current process proceeds to step S2, the process of step S2 is repeated until a predetermined time interval (the timings t0 to t1 of FIG. 4) is elapsed (NO of step S2). When a predetermined time is elapsed (YES of step S2), the current process proceeds to step S3, and it is determined whether the current temperature is a predetermined temperature or more on the basis of the temperature information of temperature detection device 17 (it is determined whether it is a no-load state S122 or a load state S121 at the timing t1 of FIG. 4). When it is the load state S121 where the current temperature is not a predetermined temperature or more (NO of step S3), it is determined that the magnetron is normally operated, and the current process proceeds to step S8.

In step S3, when it is a no-load state S122 where the current temperature is a predetermined temperature or more (YES of step S3), it is determined that a no-load operation is performed, and the current process proceeds to step S4. Then, the output reduction process of magnetron 12 is performed, and a detection flag is set in order to prevent damage of the apparatus and inform an abnormal operation.

Subsequently, the current process proceeds to step S8, and the process of step S8 is repeated until it is determined that the cooking is finished (NO of step S8). When the cooking is finished (YES of step S8), the current process proceeds to step S9, and it is determined whether the detection flag is set. When the detection flag is not set (NO of step S9), the current process proceeds to END. When the detection flag is set (YES of step S9), the current process proceeds to step S10, an error display informing the abnormal operation during cooking is generated, and the current process proceeds to END. The error display informs a customer that the cooking is not normally finished since the output reduction process is performed due to, for example, the abnormality detection. Further, the error display calls attention so that the cooking is not performed without any load by informing the no-load operation. When the history of the error display is stored, this information may be usefully used to guess the reason of failure during a service.

Even when it is determined that the repeated operations are not performed in step S1 (the no-load state S11 of FIG. 4) (NO of step S1) and the process proceeds to step S5, the same control is performed, and the process proceeds to step S8 via step S6 and step S7. That is, the process proceeds to step S8 after performing the control of step S5 corresponding to step S2, step S6 corresponding to step S3, and step S7 corresponding to step S4. At this time, in step S6, it is determined whether it is the no-load state S112 or the load state S111 at the timing t1 of FIG. 4.

Since these steps are merely an example, the step may be created so that a program may not be easily made with a determination reference. Further, the determination procedure may be made in sequence or may not be needed. Further, the method of determining a condition or the method of determining whether a current value is a predetermined value or more or a predetermined value or less may be freely used in combination to match the use method.

Hereinafter, an operation of the microwave oven with the above-described configuration will be described. In the embodiment, the abnormal temperature caused by the heating of magnetron 12 is directly transferred from anode 18 to temperature detection device 17 via cooling fin 19, and the heat may be highly efficiently transferred by reducing a temperature transfer loss. Also, the abnormality detection control may be performed on the basis of the temperature information before the cooking is started. In this manner, the erroneous detection due to the repeated heating may be prevented, the safety may be ensured, and the damage of the apparatus may be prevented.

Further, in the embodiment, temperature detection device 17 is disposed at the lower air stream side of anode 18 of magnetron 12 on the opposite side of blower 13 blowing cooling air 20. As a result, the cooling air generated from blower 13 is not directly blown to temperature detection device 17, so that the amount of heat generated from magnetron 12 may be more precisely detected.

As described above, the present invention has a configuration in which a microwave oven includes: a heating chamber for accommodating a heating object; a magnetron for heating the heating object accommodated in the heating chamber; a blower for cooling the magnetron; a temperature detection device for detecting a temperature of the magnetron; and a control device for controlling an output power of the magnetron on the basis of temperature information output from the temperature detection device, wherein the temperature detection device is disposed inside a cooling fin of the magnetron and the control device controls the magnetron on the basis of the temperature information obtained before cooking is started.

Accordingly, the temperature of the abnormal heat generated from the magnetron may be directly transferred from the anode to the temperature detection device via the cooling fin, and the heat may be highly efficiently transferred by reducing a temperature transfer loss. Also, since the abnormality detection control is performed on the basis of the temperature information obtained before the cooking is started, the erroneous detection due to repeated heating may be prevented.

Further, the present invention has a configuration in which the temperature detection device is disposed at a lower air stream side of an anode of the magnetron on the opposite side of the blower blowing cooling air toward the magnetron. Accordingly, the cooling air generated from the blower may not be directly blown to the temperature detection device, and the amount of the heat generated from the magnetron may be more precisely detected.

Furthermore, the present invention has a configuration in which the control device detects abnormality on the basis of a value of temperature increase detected by the temperature detection device in a predetermined time interval. Accordingly, the erroneous detection may be prevented in the condition where the temperature of the magnetron is high due to the repeated heating, and the detection precision may be improved by separately setting the increasing temperature value when the temperature of the magnetron is low.

INDUSTRIAL APPLICABILITY

Since the present invention improves the precision of the detection of abnormality in a no-load operation state, prevents the damage of the apparatus, and has high safety and reliability, the present invention may be applied to various microwave ovens.

DESCRIPTION OF REFERENCE NUMERALS AND SIGNS

11: HEATING CHAMBER
12: MAGNETRON
13: BLOWER
14: AIR GUIDE
15: OPERATION UNIT
16: OPENING/CLOSING DOOR
17: TEMPERATURE DETECTION DEVICE
18: ANODE
19: COOLING FIN
20: COOLING AIR
21: EXTERNAL FRAME
22: FRAME
23: CONTROL DEVICE

The invention claimed is:

1. A microwave oven comprising:

a heating chamber for accommodating a heating object;

a magnetron for heating the heating object accommodated in the heating chamber;

a blower for cooling the magnetron;

a temperature detection device for detecting a temperature of the magnetron; and a control device to control an output power of the magnetron on the basis of temperature information output from the temperature detection device, wherein the temperature detection device is disposed inside a cooling fin of the magnetron, and the control device controls the magnetron on the basis of the temperature information obtained before cooking is started, wherein the control device sets a threshold temperature value differently in dependence on the temperature information obtained before cooking is started, and wherein the control device determines a load operating condition and a no load operating condition of the microwave oven based on the threshold temperature value.

2. The microwave oven of claim 1, wherein the temperature detection device is disposed at a lower air stream side of an anode of the magnetron on the opposite side of the blower blowing cooling air toward the magnetron.

3. The microwave oven of claim 1, wherein the control device detects abnormality on the basis of a value of temperature increase detected by the temperature detection device in a predetermined time interval.

4. The microwave oven of claim 1, wherein the control device compares the temperature information obtained before cooking is started to a predetermined threshold temperature to identify that repeated operations of the microwave oven have been performed when the temperature information is at or above the threshold temperature.

5. The microwave oven of claim 4, wherein the control device determines whether the microwave oven is operated in a load state or a no load state based on whether repeated operations of the microwave oven have been performed.

6. The microwave oven of claim 1, wherein the control device is configured to obtain temperature information output from the temperature detection device a predetermined interval of time after the temperature information before cooking is obtained to determine the load operating condition and the no load operating condition of the microwave oven.

7. A microwave oven comprising:

a heating chamber configured to receive a heating object;

a magnetron configured to emit radio waves toward the heating chamber to heat the heating object;

a temperature detection device positioned adjacent to the magnetron; and a control device configured to control an output of the magnetron based on temperature information output from the temperature detection device, the control device configured to set a threshold temperature value differently in dependence on temperature information obtained from the temperature detection device before emission of radio waves by the magnetron, the threshold temperature value used by the control device to determine a load operating condition and a no load operating condition of the microwave oven.

8. The microwave oven of claim 7, wherein the temperature detection device is positioned in contact with a cooling fin positioned at an anode of the magnetron.

9. The microwave oven of claim 7, further comprising a blower configured to cool the magnetron, wherein the temperature detection device is positioned to detect the temperature of the magnetron without influence from cooling air produced by the blower.

10. The microwave oven of claim 7, wherein the temperature detection device is positioned between a first cooling fin and a second cooling fin, the first cooling fin and the second cooling fin being disposed at a predetermined interval around an anode of the magnetron.

11. A microwave oven comprising:

a heating chamber configured to receive a heating object;

a magnetron configured to output radio waves toward the heating chamber to heat the heating object;

a temperature detection device positioned adjacent to the magnetron; and a control device configured to obtain a first temperature information output from the temperature detection device before output by the magnetron, and obtain a second temperature information at a predetermined period of time after output by the magnetron has occurred to determine a load operating condition and a no load operating condition of the microwave oven, the control device further configured to control an output power of the magnetron based on the determination.

12. The microwave oven of claim 11, wherein the control device is configured to reduce the output power of the magnetron and generate an error display in response to determination of the no load operating condition.

13. The microwave oven of claim 11, wherein the first temperature information output from the temperature detection device indicates that the microwave oven has been repeatedly operated or that the microwave oven has not been repeatedly operated, the first temperature information being indicative of a higher temperature where the microwave oven has been repeatedly operated.

14. The microwave oven of claim 11, wherein the first temperature information output from the temperature detection device is indicative of a first temperature when the microwave oven has not been repeatedly operated, and is indicative of a second temperature when the microwave oven has been repeatedly operated, the second temperature being higher than the first temperature.

* * * * *